US006910595B2

(12) United States Patent
Renz

(10) Patent No.: US 6,910,595 B2
(45) Date of Patent: Jun. 28, 2005

(54) HOLDER ASSEMBLY

(75) Inventor: Charles J. Renz, Briarcliff Manor, NY (US)

(73) Assignee: Playtex Products Inc., Westport, CT (US)

( * ) Notice: Subject to any disclaimer, the term of this patent is extended or adjusted under 35 U.S.C. 154(b) by 0 days.

(21) Appl. No.: 10/426,902

(22) Filed: Apr. 30, 2003

(65) Prior Publication Data

US 2004/0217080 A1 Nov. 4, 2004

(51) Int. Cl.[7] ..... A61J 9/00; A61J 9/06; A61J 9/08

(52) U.S. Cl. ..... 215/11.6; 215/11.3; 220/495.03; 220/578

(58) Field of Search ..... 215/11.1, 11.3, 215/11.6, 391; 222/386; 220/495.03, 495.06, 578; 206/389, 877; 401/82

(56) References Cited

U.S. PATENT DOCUMENTS

| | | | | | |
|---|---|---|---|---|---|
| 1,325,859 | A | * | 12/1919 | Phillips | 215/12.1 |
| 2,876,113 | A | * | 3/1959 | Barton | 426/117 |
| 2,881,935 | A | * | 4/1959 | Garred | 215/11.3 |
| 3,561,644 | A | * | 2/1971 | Works et al. | 222/95 |
| 3,955,698 | A | | 5/1976 | Hammer | 215/11 E |
| 3,998,348 | A | | 12/1976 | Sammaritano | 215/11 E |
| 4,176,754 | A | | 12/1979 | Miller | 215/11 E |
| 4,235,040 | A | | 11/1980 | Trowbridge | 46/79 |
| 4,700,856 | A | * | 10/1987 | Campbell et al. | 215/11.3 |
| 4,796,767 | A | | 1/1989 | McKeown | 215/11.1 |
| 5,020,680 | A | | 6/1991 | Bale | 215/11.6 |
| D325,973 | S | | 5/1992 | Chen et al. | D24/197 |
| D326,523 | S | | 5/1992 | Chen et al. | D24/197 |
| 5,301,825 | A | | 4/1994 | Di Scala et al. | 215/11.1 |
| 5,356,016 | A | | 10/1994 | Wiedemann | 215/11.3 |
| 5,579,935 | A | | 12/1996 | Atkin et al. | 215/11.1 |
| 5,878,899 | A | | 3/1999 | Manganiello et al. | 215/11.6 |
| D411,886 | S | | 7/1999 | Manganiello | D24/197 |
| D460,825 | S | | 7/2002 | Renz | D24/199 |

* cited by examiner

*Primary Examiner*—Sue A. Weaver
(74) *Attorney, Agent, or Firm*—Ohlandt, Greeley, Ruggiero & Perle L.L.P.

(57) ABSTRACT

A holder assembly for use with a flexible liner is provided having a holder with a longitudinal slot and a plunger. The plunger has a disk and a positioner joined to the disk. The positioner engages the longitudinal slot to mount the disk slidably in the holder. The plunger is readily adapted for assembly and disassembly with the holder.

96 Claims, 4 Drawing Sheets

HOLDER ASSEMBLY

BACKGROUND OF THE INVENTION

1. Field of the Invention

The present invention relates to a holder assembly for dispensing baby formula and the like. More particularly, this invention relates to a holder assembly that includes a holder for use with a disposable liner or sac, and a sliding member removably secured to the holder for expelling air from the liner.

2. Description of the Prior Art

Reusable baby bottles or hard bottles, such as made of glass or plastic, have been commonly used to feed babies formula, water, and other liquids. After liquid is placed in the bottle, a nipple is attached to the bottle and the assembly is ready for use. A hard bottle sometimes is cleaned and sterilized between each use, requiring substantial time and effort.

An alternative to a hard bottle is the flexible or disposable liner or sac (also referred to as a "disposable bottle") that is used in conjunction with a holder which supports the liner. The liner, which is used only once, is pre-sterilized, and is inserted into the holder. The liner is then filled with liquid, and a nipple is attached to the holder. This alternative is economical and sanitary, and greatly minimizes the time and effort required to prepare for feeding a baby.

One limitation inherent in hard bottles is the tendency of babies to ingest substantial amounts of air when ingesting the liquid. This air can cause uncomfortable distention and gas in the baby's stomach, and may lead to vomiting and other problems. Disposable liners collapse as liquid is drawn out, thus minimizing the amount of air the baby ingests. However, under some circumstances a small amount of air can be drawn into the liner through the hole of the nipple.

Attempts have been made to address this problem. U.S. Pat. No. 3,998,348 to Sammaritano provides a roller assembly attached to the lower, closed end of the liner to take up the liner as it empties. U.S. Pat. No. 4,796,767 to McKeown provides a pushrod stored on the outside of the holder. When in use, the pushrod is inserted through the open bottom of the holder to press air out of the liner through hole in the attached nipple. U.S. Pat. No. 4,176,754 to Miller provides a donut-shaped pneumatic roller used to press air out of the liner similarly as discussed above.

Some patents provide a plunger-type insert having the general shape of the inside of the holder. The plunger can be pushed up within the holder to press air out of the liner. Certain devices use a plunger having a stem extending from the open bottom of the holder. Other devices require the user to reach inside the open bottom of the holder to operate the plunger.

Other patents provide a refinement on this construction employing a plunger-type insert that is operable by means located on the sides of the holder. U.S. Pat. No. 5,356,016 to Wiedemann provides a flat, circular plunger member having a pair of tab handles on its diameter that extend through a pair of longitudinal slots in the holder.

U.S. Pat. No. 3,955,698 to Hammer is a device somewhat similar to that shown in the Wiedemann patent. However, the Hammer device has a pair of tab handles that engage with ratcheted indentations on the interior surface of the holder. U.S. Pat. No. 5,301,825 to Di Scala et al. provides a related device in which the tab handles are connected in a ring extending around the holder.

These devices tend to be unwieldy, unstable and awkward. These devices suffer from the drawback of requiring a complex disassembly of the tab or ring handles to clean the holder assembly. This is inconvenient and time-consuming for the user. Also, removable tab handles can pose a danger to the baby as small parts. These devices also suffer from the drawback of requiring two hands to operate properly. The tab handle devices require the user to hold the holder in one hand, and apply pressure, preferably with the other hand, to the opposing tab handles simultaneously. The ring device requires the user to grasp the holder in one hand, and the ring, preferably with the other hand and at opposing points, to slide it. If used with one hand, slight movements of the ring might be possible, but any greater pressure may force the ring's edge into the holder surface and arrest further movement. These devices additionally suffer from the drawback of being bulkier than the present holder, thereby making these known devices less attractive and more expensive to manufacture.

Patents disclosing a holder assembly designed to alleviate such drawbacks are disclosed in U.S. Pat. No. 5,878,899 to Manganiello et al. and U.S. Design Pat. No. 411,886, which are assigned to the assignee of the present application. Applicant hereby incorporates the disclosures of these patents by reference. The holder assembly is for use with disposable baby feeding liners and has a holder with a longitudinal slot and a member. The member has a disk and a finger-operated attachment joined to the disk at a single location. The attachment engages the longitudinal slot to mount the disk slidably within the holder. The holder has markings for determining the volume of liquid entering into the liner and the volume of liquid remaining in the liner as the baby is feeding. While a significant improvement over the known devices, this holder can have a simpler assembly and disassembly procedure. This device also does not provide significant leverage to the user for squeezing out the air in the liner.

Accordingly, there is a need for holders for flexible liners that facilitate assembly and operation while maintaining safety for the infant and reducing cost of manufacture.

SUMMARY OF THE INVENTION

It is an object of the present invention to provide a holder assembly that provides for efficient expulsion of air from a disposable flexible liner or preformed sac.

It is another object of the present invention to provide such a holder assembly that allows air removal from the liner, and can be held and operated effectively, easily and comfortably by the user, and preferably by use of one hand.

It is a further object of the present invention to provide such a holder assembly that facilitates operation, assembly, disassembly and cleaning.

These and other objects and advantages of the present invention are provided by a holder assembly for a disposable liner that expels air from the liner, which comprises a holder having an outer circumference and an axial slot; and a plunger having a disk and a positioner connected to the disk. The disk is removably disposed in the holder and movable in an axial direction in the holder to urge air from the liner. At least a portion of the positioner is accessible from outside of the holder along the axial slot and movable along the axial slot. The plunger engages the axial slot without engaging the holder in an area opposite the axial slot. The holder can have an axial channel inwardly recessed from the outer circumference with the axial channel having a width that allows at least a portion of the positioner to move through the axial channel along the axial slot and the axial slot can be formed in the axial channel.

In another aspect of the present invention, a holder assembly for a disposable liner that expels air from the liner is provided. The assembly comprises a holder having a first axial track, a second axial track and an outer circumference, and a plunger having a disk and a positioner. The disk is removably disposed in the holder and movable in an axial direction with respect to the holder to urge air from the liner. At least a portion of the positioner is accessible from outside of the holder along the first and second axial tracks. The positioner engages the first and second tracks without engaging the holder in an area opposite the first and second axial tracks. The positioner is movable along the first and second tracks.

In another aspect of the present invention, a holder assembly for a disposable liner that expels air from the liner is provided. The assembly comprises a holder having an outer circumference, an opening, and an axial slot in communication with the opening and formed by first and second walls, and a plunger having a disk and a positioner connected to the disk. The disk is removably disposed in the holder and movable in an axial direction in the holder to urge air from the liner. At least a portion of the positioner is accessible from outside of the holder along the axial slot. The positioner engages the axial slot along the first and second walls without engaging the holder in an area opposite the axial slot. The opening is at least partially defined by the first and second walls. The positioner can be selectively engaged and disengaged with the axial slot though the opening. The holder can have a first contact area and a second contact area. The first contact area is a first surface area of those portions of the first and second walls that are engaged with the positioner when the positioner is remote from the opening. The second contact area is a second surface area of those portions of the first and second walls that are engaged with the positioner when the positioner is in proximity to the opening. The first contact area can be greater than the second contact area.

In another aspect of the present invention, a holder assembly for a disposable liner that expels air from the liner is provided. The assembly comprises a holder having an outer circumference and an axial slot, and a plunger having a disk, a positioner connected to the disk and a pad connected to the positioner. The disk is removably disposed in the holder and movable in an axial direction in the holder along the axial slot to urge air from the liner. The positioner engages the axial slot without engaging the holder in an area opposite the axial slot. The pad is accessible from outside of the holder along the axial slot. The pad is made from a first material, and the positioner is made from a second material. The first material is softer than the second material.

In another aspect of the present invention, a holder assembly for a disposable liner that expels air from the liner is provided. The assembly comprises a holder having an outer circumference, a single axial slot, and a single axial channel. The axial slot is formed by first and second walls and is disposed in the axial channel. The first and second walls have inner and outer surfaces. The holder assembly further comprises a plunger having a positioner. The plunger is partially disposed in the holder and movable along a longitudinal axis of the holder to urge air from the liner. The positioner engages the inner and outer surfaces of the first and second walls. A portion of the positioner is accessible from outside of the holder and adjacent to the axial slot. The axial slot has an opening at its first end. The opening has an area smaller than an area of the portion of the positioner to allow selective removal of the positioner from the holder. The positioner can engage the inner and outer surfaces of the first and second walls without engaging the holder in an area opposite the axial slot.

In another aspect of the present invention, a holder assembly for a disposable liner that expels air from the liner is provided. The assembly comprises a holder having an axial slot and an opening, and a plunger having a positioner removably engaged with the axial slot. The plunger is partially disposed in the holder and movable along the axial slot to urge air from the liner. At least a portion of the positioner is accessible from outside of the holder and adjacent to the axial slot. The positioner engages the axial slot without engaging the holder in an area opposite the axial slot. The positioner is disengageable from the axial slot by moving the positioner in only a first single direction when the positioner is in proximity to the opening. The positioner can engage with the axial slot by moving the positioner in only a second single direction when the positioner is in proximity to the opening. The second direction can be opposite to the first direction. The first single direction can be a rotational direction. The axial slot can have at least one detent structure disposed adjacent to the opening that allows disengagement of the positioner from the axial slot by movement of the positioner in only the first single direction when the positioner is in proximity to the opening. The detent structure can be a first tapered edge and a second tapered edge. The first tapered edge can be formed on a first wall along a first end of the axial slot adjacent to the opening, and the second tapered edge can be formed on a second wall along the first end of the axial slot adjacent to the opening.

The holder can have an axial channel inwardly recessed from the outer circumference that has a width that allows at least a portion of the positioner to move through the axial channel along the axial slot. The axial slot can be formed in the axial channel. The holder can be transparent. The holder assembly can further have a nipple ring and a nipple removably securable to the holder. The axial channel can be partially formed by a first wall and a second wall. The first and second walls can be disposed along a bottom of the axial channel and the axial slot can be disposed between the first and second walls. The holder can have an opening in communication with the axial slot that allows for engagement and disengagement of the plunger with the axial slot. The opening can be at least partially formed by the first and second walls.

The pad can be co-molded with the positioner. The first material can be a thermoplastic elastomer. The axial channel can be partially formed by a third wall and a fourth wall, and the third and fourth walls can be disposed along opposing sides of the axial channel. The holder can have an opening in communication with the axial slot that allows for engagement and disengagement of the plunger with the axial slot, wherein the opening is defined by a portion of the first, second, third and fourth walls. The third and fourth walls can be substantially orthogonal to the first and second walls.

The positioner can have a plate, a rib, and an actuator. The plate can be secured to the disk. The actuator can be accessible from outside of the holder. The rib can connect the plate to the actuator. The rib can be disposed in the axial slot. The actuator can be at least partially disposed in the axial channel when the plunger is engaged with the axial slot. The rib, the plate and the actuator can define a pair of channels that engage with the first and second walls. The positioner can have a plurality or number of glide ridges that contact the first and second walls when the positioner is moved along the axial slot. In a front view, the positioner can have a square or rectangular shape and the opening can have a trapezoidal shape. The disk can have a circumferential lip to form a cup-like shape.

The holder can have an upper end with a first diameter and a lower end with a second diameter. The second diameter can be larger than the first diameter. The holder can have a middle portion with a third diameter. The first and second diameters are greater than the third diameter. The lower end can have a stabilizing structure. The stabilizing structure can be an outwardly extending bead.

Other and further objects, advantages and features of the present invention will be understood by reference to the following.

DESCRIPTION OF THE INVENTION

Figure 1:
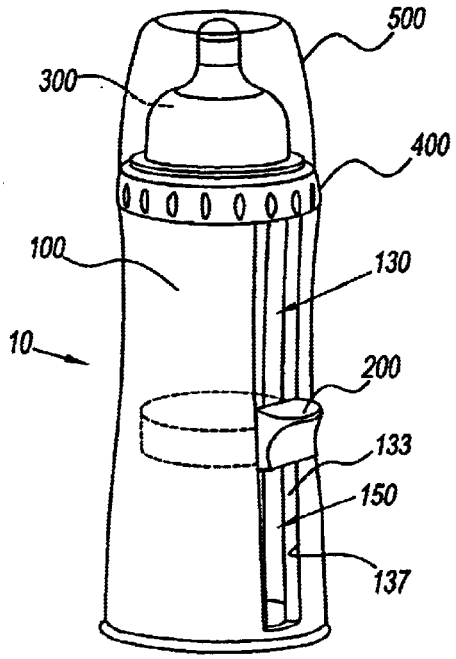
FIG. 1 is a front perspective view of a holder assembly of the present invention.
Figure 2:
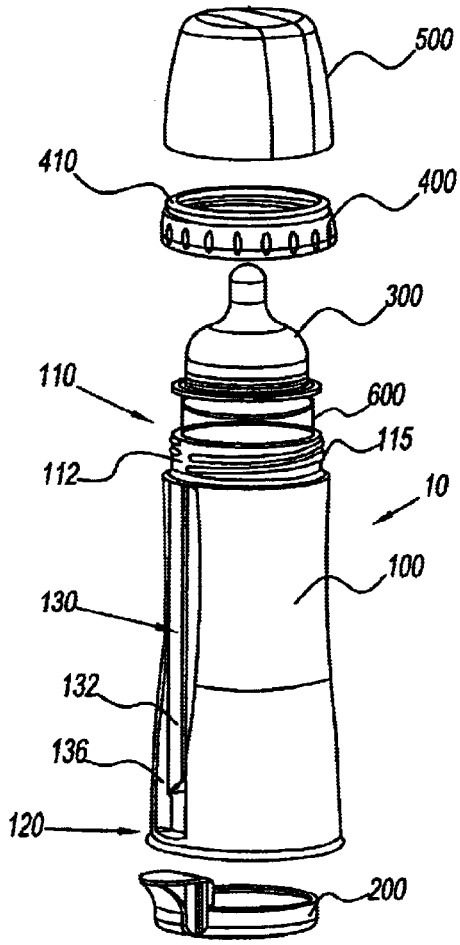
FIG. 2 is an exploded perspective view of the holder assembly of FIG. 1.
Figure 3:
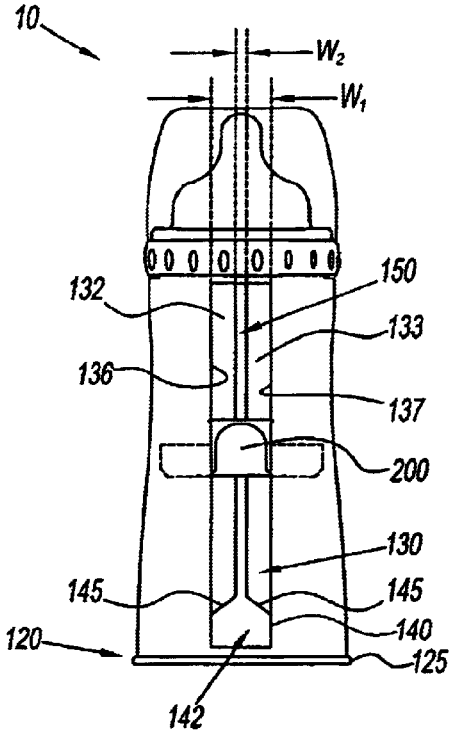
FIG. 3 is a front view of the holder assembly of FIG. 1.
Figure 4:
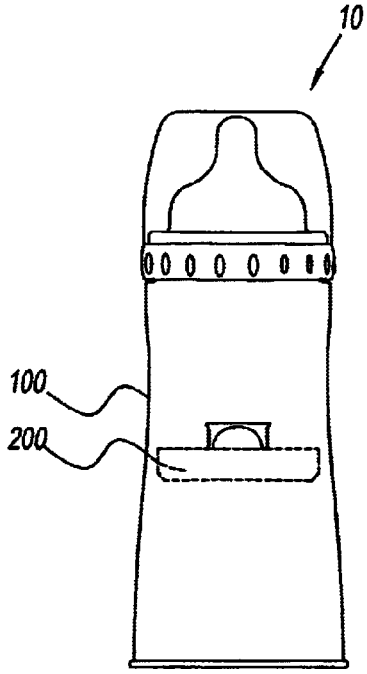
FIG. 4 is a rear view of the holder assembly of FIG. 1.
Figure 5:
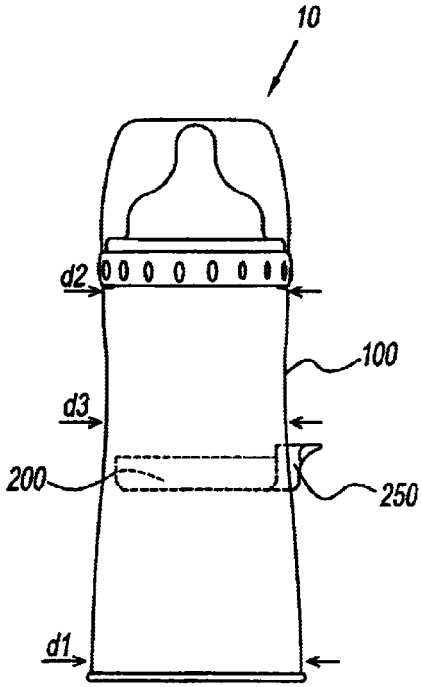
FIG. 5 is a side view of the holder assembly of FIG. 1.
Figure 6:
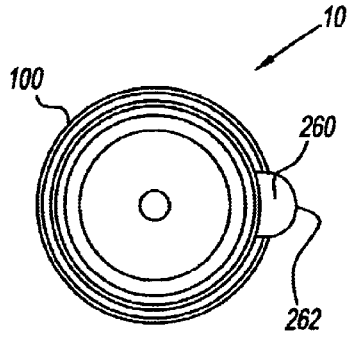
FIG. 6 is a top view of the holder assembly of FIG. 1.
Figure 7:
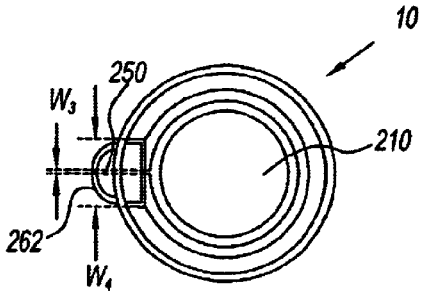
FIG. 7 is a bottom view of the holder assembly of FIG. 1.

Referring to the drawings and, in particular, FIGS. 1 and 2, there is shown a holder assembly according to the present invention generally represented by reference numeral 10. The holder assembly 10 includes a hollow body, sleeve or holder 100 and a plate, burper or plunger member 200 adapted to be selectively retained with the holder but movable with respect to the holder.

The holder assembly 10 may include for use a nipple 300, a nipple retaining ring 400, a cap 500 and a disposable or flexible liner 600. Examples of such liners are found in U.S. Pat. No. 6,123,222 to Richiger et al., U.S. Pat. No. 6,110,091 to Morano, and U.S. Pat. No. 5,806,711 to Morano et al., which are assigned to the assignee of the present application. Applicant hereby incorporates the disclosures of these patents by reference.

Referring to FIGS. 1 through 7, the holder 100 is preferably a hollow cylindrical tube that is open at an upper end 110 and a lower end 120. Holder 100 has an ergonomic shape that facilitates gripping by the parent when the feeding process is being prepared and also facilitates gripping during the feeding process. In this embodiment, lower end 120 smoothly transitions into upper end 110 over the length of the holder. Preferably, lower end 120 has a diameter $d_1$ that is larger than a diameter $d_2$ of upper end 110. More preferably, holder 100 has a middle portion with a diameter $d_3$ that is smaller than diameters $d_1$ and $d_2$ such that the holder has a narrowed or reduced waist for the user to hold while feeding. The outer surface of holder 100 can also have gripping structures and/or information, such as, for example, measurements.

Upper end 110 preferably has a diameter between about 2.0 inches to about 2.4 inches. More preferably, the diameter of upper end 110 is about 2.25 inches. Preferably, lower end 120 has a diameter between about 2.45 inches to about 2.75 inches. More preferably, the diameter of lower end 120 is about 2.56 inches. The enlarged diameter of lower end 120 facilitates access to the interior volume of holder 100 for cleaning and for positioning of liner 600. The enlarged diameter of lower end 120 also facilitates disassembly of plunger member 200 from holder 100, as will be discussed later in detail. Holder 100 preferably has a substantially uniform wall thickness of between about 0.03 inches to about 0.10 inches, and more preferably about 0.06 inches. The shape and size, including wall thickness, of the holder 100 facilitates manipulation by the user.

Lower end 120 of the holder 100 preferably has a bottom edge 125, which is more preferably in the form of a bead or other stabilizing projection or structure. The edge 125 is preferably about 0.13 inches high and about 0.06 inches wide. Alternative structures can also be used for edge 125 such as, for example, an enlarged solid bottom edge to provide strength and rigidity to the structure. The edge 125 can be flared outward to provide stability to the holder 100 when it is placed in an upright position.

The holder 100 can be any material that will hold the liner 600 in position therein. The holder 100 is preferably formed of a rigid molded material, such as a rigid thermoplastic that will not warp. More preferably, the holder 100 is made of polypropylene. However, the holder 100 can be made of other materials, such as, for example, polycarbonate or other rigid thermoplastics. The holder 100 preferably is made of a transparent or semi-transparent material that allows the user to view the liner 600 in the holder and also allows the user to view the position of the plunger 200. Preferably, plunger 200 has a contrasting color with respect to holder 100 to facilitate visual indication of the positioning of the plunger in the holder.

The holder 100 has a longitudinal or axial recess or channel 130 that is formed by a first wall 132, a second wall 133, a third wall 136, and a fourth wall 137. First and second walls 132, 133 are substantially parallel with the outer circumference of holder 100 and inwardly recessed from the outer circumference of the holder. Third and fourth walls 136, 137 are substantially orthogonal to the outer circumference of holder 100 and to first and second walls 132, 133. Preferably, channel 130 extends along a substantial length (from upper end 110 to lower end 120) of holder 100.

First and second walls 132, 133 have a space or slot 150 disposed therebetween. Preferably, slot 150 extends along a substantial length of channel 130. More preferably, slot 150 is centrally disposed along channel 130. The channel 130 and the slot 150 preferably have uniform widths or circumferential extants $w_1$ and $w_2$, respectively. The width $w_1$ of channel 130 is preferably between about 0.70 inches to about 0.85 inches. More preferably, the width $w_1$ of channel 130 is about 0.77 inches. The width $w_2$ of slot 150 is preferably between about 0.10 inches to about 0.18 inches. More preferably, the width $w_2$ of slot 150 is about 0.13 inches. Channel 130 and slot 150 are guides or tracks for the axial or longitudinal movement of plunger member 200 with respect to holder 100. Preferably, holder 100 provides at least two guides or tracks for the movement of plunger 200, i.e., channel 130 and slot 150. The size of first and second walls 132, 133 and third and fourth walls 136, 137 are such that the channel 130 facilitates movement of plunger member 200. First and second walls 132, 133, third and fourth walls 136, 137, and slot 150 have a size and shape that reduce or eliminate lateral movement of plunger member 200, while allowing axial movement of the plunger along a substantial length of the holder 100.

Figure 8:
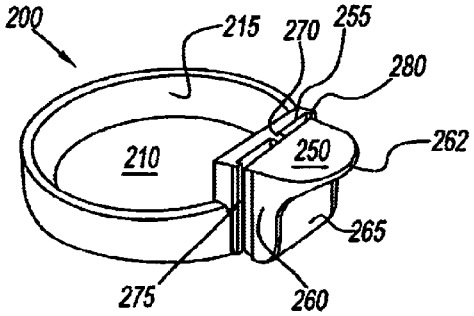
FIG. 8 is a top perspective view of the plunger of FIG. 1.
Figure 9:
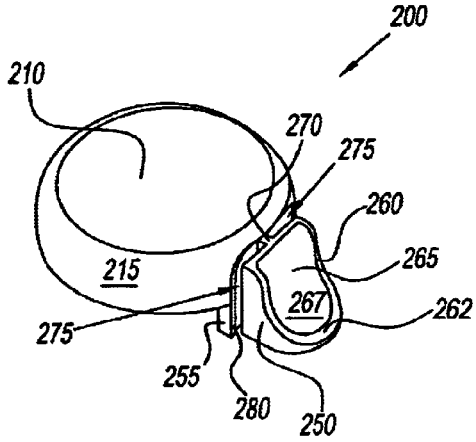
FIG. 9 is a bottom perspective view of the plunger of FIG. 8.
Figure 10:
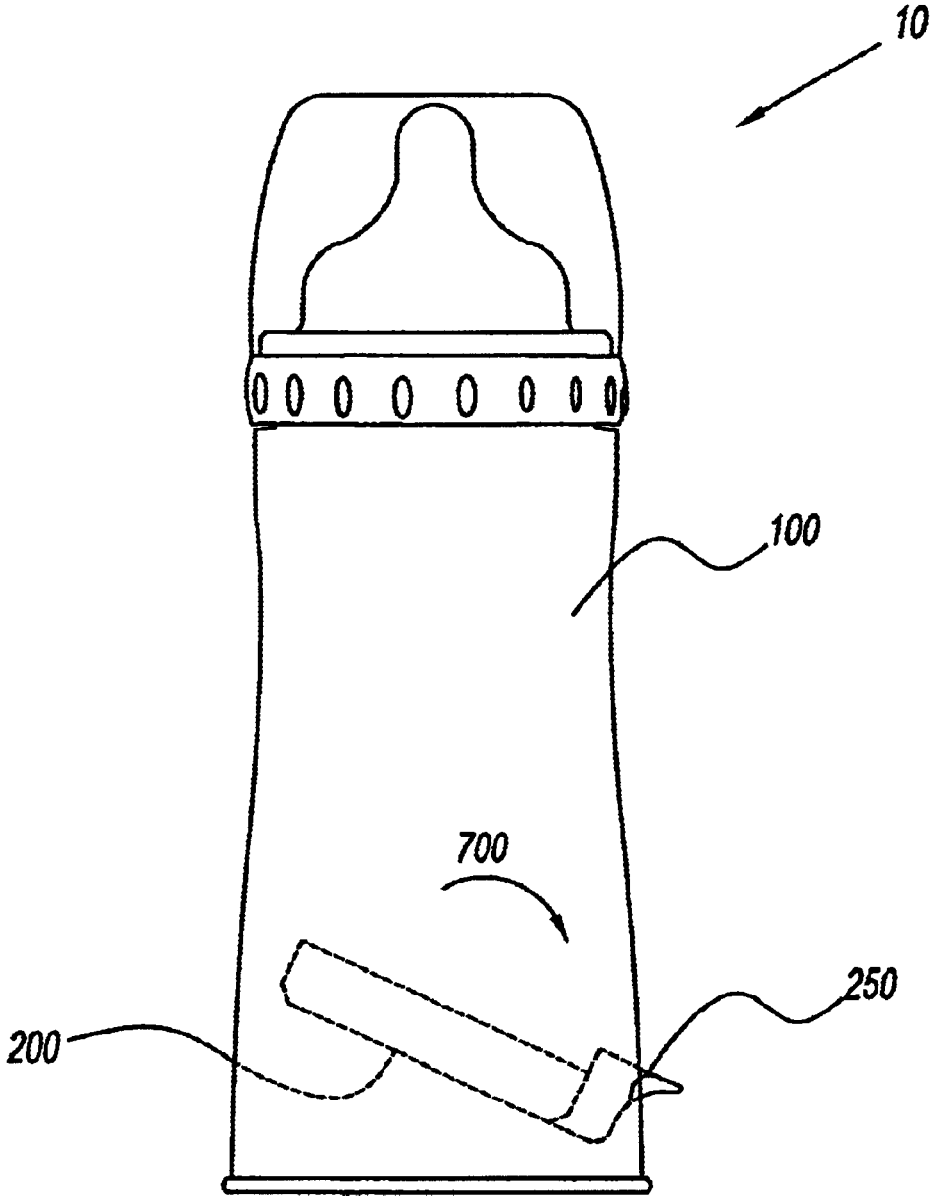
FIG. 10 is a side view of the holder assembly of FIG. 1 when the plunger is being disassembled.

Referring to FIGS. 8 and 9, the plunger member 200 is, preferably, a single integral piece that includes a disk 210 and a tangentially connected positioner 250. The disk 210 is preferably slim and circular, and corresponds to the interior shape of holder 100. Where an alternative shape for holder 100 is used, such as, for example, oblong or ellipsoidal, disk 210 would have the corresponding shape so that the disk could move within the interior volume or space of the holder. Disk 210 preferably has a lip 215 about its circumference that forms a cup-shaped surface on the disk. The outer diameter of disk 210 and lip 215 is sized slightly less than the inner diameter of the holder 100 so as to permit the disk to move up and down within the holder. The cup-shaped configuration of the disk 210 can hold the bottom of the liner 600 therein, and can help to prevent the liner from falling or being pinched between the disk and the inner wall surface of the holder 100 as the plunger member 200 slides along the inside of the holder. While disk 210 is preferably integrally formed with positioner 250, alternatively, the disk and positioner can be secured or attached to each other, such as, for example, adhesive.

Referring to FIGS. 6 through 9, the positioner 250 preferably has a plate 255 that is formed integrally with the disk 210 and extends upward and beyond the lip 215 of the disk. The positioner 250 also has an actuator 260 having a pad 265, and an elongated bridge or rib 270 that connects the plate 255 and the actuator together, preferably at their center portions. On either side of rib 270 between plate 255 and actuator 260, there are formed channels 275. Rib 270 has a width $w_3$ and actuator 260 has a width $w_4$. Each channel 275 is designed to accept and engage first and second walls 132, 133 of channel 130 such that rib 270 is disposed in axial slot 150. Channels 275 are engaged with the inner and outer surfaces of first and second walls 132, 133. Plunger 200 is movably secured to holder 100 along axial channel 130 and axial slot 150 but is preferably not secured to the holder on the side opposite the axial channel and slot. The disk 210 is separated from the holder 100 along the side opposite to the axial channel 130 and the axial slot 150. The width $w_4$ of the actuator 260 is less than the width $w_1$ of the axial channel 130 (shown in FIG. 3) so that the actuator 260 is partially recessed in the axial channel.

Pad 265 is preferably arched in shape to approximate the contours of the user's thumb. Preferably, actuator 260 has an upper edge 262 that flares outwardly away from the outer surface of holder 100 to form a thumb-accepting flared surface 267 in pad 265. Upper edge 262 extends between about 0.25 inches to about 0.85 inches from holder 100, and more preferably extends about 0.45 inches from the holder. The extended distance of upper edge 262 from the holder 100 provides a user with added leverage for sliding plunger 200 along the inner volume of the holder. This added leverage is of great benefit to the user where a force is needed to squeeze out air from the liner 600, and is especially significant to facilitate preparation and use of the holder assembly 10 with only one hand.

Pad 265 is preferably made of a soft material to provide comfort to a user, such as, for example, thermoplastic elastomer (TPE). Preferably, pad 265 has a Shore A hardness between about 30 to about 70, and more preferably about 50. Pad 265 is preferably co-molded with actuator 260, but the present invention contemplates the use of other attachment methods or structures between pad 265 and actuator 260.

When plunger member 200 is to be moved axially upward, the user's thumb or other finger can engage and press up on the flared surface 267 or the underside of the pad 265. When plunger 200 is to be moved axially downward, the thumb can rest on and press down on the top side of the same flared surface 267.

Channels 275 can also have glide ridges 280 formed along the inner surfaces of either or both of plate 255 and/or actuator 260. The glide ridges 280 are disposed adjacent to the inner and outer surfaces of first and second walls 132, 133 and reduce the contact area between the first and second walls and the positioner 250 to reduce friction when the positioner 250 is moved with respect to the holder 100. Any number of glide ridges 280 can be used.

Plunger member 200 and/or holder 100 can have frictional engagement structures, such as, for example, detent or ratcheting structures, to keep the plunger from sliding in slot 150 absent any pressure from the user or to prevent the plunger from sliding back down the holder. The force applied by the user to pad 265 to overcome this frictional engagement would be small enough to allow easy and smooth one-handed operation of holder assembly 10.

Referring to FIGS. 1 through 9, channel 130 preferably has a lower end 140 defining an opening 142. More preferably, opening 142 has a trapezoidal shape. First and second walls 132, 133 terminate at the upper extant of opening 142 and have holding or detent structures 145 for selectively holding or retaining plunger 200 in opening 142. In the preferred embodiment, detent structures 145 are tapered or angled edges of first and second walls 132, 133 that partially define the trapezoidal shape of the opening. The opening 142 provides for insertion and removal of plunger 200 into channel 130 and slot 150, while the detent structures 145 facilitate such insertion and removal by providing a limited resistance to the insertion and removal. Tapered edges 145 provide a reduced contact area, as opposed to the entire width of first and second walls 132, 133, to facilitate the insertion and removal of plunger 200. In the preferred embodiment, a trapezoidal-like shape is used for opening 142. However, the present invention contemplates other shapes for opening 142 that provide detent structures 145 to selectively hold plunger 200 in engagement with holder 100 but that can also be overcome with minimal force and manipulation to facilitate the assembly and disassembly of the plunger with the holder. Also, while the preferred embodiment has opening 142 at lower end 140, the present invention contemplates positioning of opening 142 at other positions along axial channel 130 and axial slot 150.

Referring to FIGS. 1 through 10, the user can disassemble plunger 200 from holder 100 by lowering positioner 250 into opening 142 so that plunger 200 is only being retained in channel 130 by tapered edges 145 of first and second walls 132, 133. The user can push down on outer edge 262 of actuator 260 so that the opposite end of plunger 200 is rotated upwards (towards upper end 110 of holder 100) as shown by arrow 700 in FIG. 10. The upward rotation of the plunger 200 releases the engagement between channels 275 and tapered edges 145 so that the plunger is disassembled from the holder 200. The tapered shaped of edges 145 provide for a snap-like disengagement or disassembly of the plunger 200 and holder 100. The plunger 200 can then be removed from the holder 100 through open lower end 120. The plunger 200 is reinserted or assembled with holder 100 by reversing this process. The disassembly of plunger 200 from holder 100 preferably requires only movement of the plunger in a single direction 700. More preferably, the single direction 700 is a rotational direction or movement. Similarly, assembly of plunger 200 with holder 100 preferably only requires movement of the plunger in an opposing single direction, which is more preferably a rotational direction or movement.

In use, liner 600 is inserted into holder 100. Liquid is poured into the liner, and nipple 300 and nipple retaining ring 400 are secured to holder 100, thus securing the liner in the holder. The plunger 200 is moved up firmly against the liner 600 maintaining the pressure on the liner until all the air is purged through an aperture in nipple 300 and a small amount of liquid is dispensed. The holder assembly 10 is inverted into feeding position and the fluid can be withdrawn by the infant. The actuator 260 and pad 265 is pressed with the thumb (or other finger) to slide plunger member 200, and in particular disk 210, up within the holder 100. The disk 210 maintains slight compression on the fluid-filled liner 600 and thereby minimizes any air returning to the liner.

The upper end 110 of holder 100 has a neck 112, preferably of reduced diameter, adapted to accept the retaining ring 400. Preferably, the neck 112 has a threaded surface 115, which mates with interior threads on retaining ring 400. Liner 600 can have a rim that rests on the rim of neck 112 of holder 100 and is secured in place by retaining ring 400. Alternatively, the neck 112 can be a smooth surface and/or biased inward from the top to the bottom in order to receive the retaining ring 400 having an alternative non-threaded interior surface. The bias would be approximately ten degrees to the vertical axis with a tolerance of plus or minus one-half degree. The cap 500 can be removably secured to nipple ring 400. Preferably, nipple ring 400 has an upper lip 410 with an outer diameter corresponding to the inner diameter of the lower end of cap 500 so that a snap-fit engagement of the cap and lip is provided. Upper lip 410 and/or the lower end of cap 500 can have detents or detent means such as, for example, annular beads, to provide for a snap fit between nipple ring 400 and the cap.

The present invention having been thus described with particular reference to the preferred forms thereof, it will be obvious that various changes and modifications may be made therein without departing from the spirit and scope of the present invention as defined in the appended claims.

What is claimed is:

1. A holder assembly for a disposable liner that expels air from said liner, said holder assembly comprising:

a holder having an outer circumference and an axial channel inwardly recessed from said outer circumference, wherein said axial channel has a channel width; and a plunger having a disk and a positioner connected to said disk, wherein said positioner has a positioner width, wherein said disk is removably disposed in said holder and movable in an axial direction in said holder to urge air from said liner, wherein said positioner has at least a portion thereof that is accessible from outside of said holder along said axial channel and movable along said axial channel, wherein said plunger engages said axial channel, wherein said plunger is separated from said holder along an area opposite said axial channel, and wherein said channel width is greater than said positioner width so that said positioner is at least partially recessed in said axial channel.

2. The holder assembly of claim 1, wherein said holder has an axial slot formed in said axial channel.

3. The holder assembly of claim 2, wherein said holder is transparent.

4. The holder assembly of claim 2, further comprising a nipple ring and a nipple removably securable to said holder.

5. The holder assembly of claim 2, wherein said axial channel is partially formed by a first wall and a second wall, wherein said first and second walls are disposed along a bottom of said axial channel, and wherein said axial slot is disposed between said first and second walls.

6. The holder assembly of claim 2, wherein said holder has an opening in communication with said axial slot that allows for engagement and disengagement of said plunger with said axial slot.

7. The holder assembly of claim 5, wherein said holder has an opening in communication with said axial slot that allows for engagement and disengagement of said plunger with said axial slot, and wherein said opening is at least partially formed by said first and second walls.

8. The holder assembly of claim 2, wherein said plunger has a pad connected to said positioner and accessible from outside of said holder, and wherein said pad is made from a first material, said positioner is made from a second material, and said first material is softer than said second material.

9. The holder assembly of claim 8, wherein said pad is co-molded with said positioner.

10. The holder assembly of claim 8, wherein said first material is a thermoplastic elastomer.

11. The holder assembly of claim 5, wherein said axial channel is partially formed by a third wall and a fourth wall, and wherein said third and fourth walls are disposed along opposing sides of said axial channel.

12. The holder assembly of claim 11, wherein said holder has an opening in communication with said axial slot that allows for engagement and disengagement of said plunger with said axial slot, wherein said opening is defined by a portion of said first, second, third and fourth walls, and wherein said third and fourth walls are substantially orthogonal to said first and second walls.

13. The holder assembly of claim 5, wherein said positioner comprises a plate, a rib, and an actuator, wherein said plate is connected to said disk, wherein said actuator is accessible from outside of said holder, wherein said rib connects said plate to said actuator, and wherein said rib is disposed in said axial slot and said actuator is at least partially disposed in said axial channel when said plunger is engaged with said axial slot.

14. The holder assembly of claim 13, wherein said rib, said plate and said actuator define a pair of channels that engage with said first and second walls.

15. The holder assembly of claim 14, wherein said positioner has at least one glide ridge that contacts either or both of said first and second walls when said positioner is moved along said axial slot.

16. The holder assembly of claim 6, wherein said positioner has a square or rectangular shape as viewed in a front view, and wherein said opening has a trapezoidal shape as viewed in said front view.

17. The holder assembly of claim 6, wherein said disk has a circumferential lip to form a cup-like shape.

18. The holder assembly of claim 2, wherein said holder has an upper end with a first diameter and a lower end with a second diameter, and wherein said second diameter is greater than said first diameter.

19. The holder assembly of claim 18, wherein said holder has a middle portion with a third diameter, and wherein said first and second diameters are greater than said third diameter.

20. The holder assembly of claim 18, wherein said lower end has a stabilizing structure.

21. The holder assembly of claim 20, wherein said stabilizing structure is an outwardly extending bead.

22. A holder assembly for a disposable liner that expels air from said liner, said holder assembly comprising:

a holder having a first axial track, a second axial track with a track width and an outer circumference; and a plunger having a disk and a positioner, said positioner having a positioner width, wherein said disk is removably disposed in said holder and movable in an axial direction with respect to said holder to urge air from said liner, wherein said positioner has at least a portion thereof that is accessible from outside of said holder along said first and second axial tracks, wherein said positioner engages said first and second axial tracks, wherein said disk is separated from said holder along an area opposite said first and second axial tracks, wherein said positioner is movable along said first and second axial tracks, and wherein said track width of said second axial track is greater than said positioner width so that said positioner is at least partially recessed in said second axial track.

23. The holder assembly of claim 22, wherein said first axial track is an axial slot, wherein said second axial track is an axial channel inwardly recessed from said outer circumference, and wherein said axial slot is disposed in said axial channel.

24. The holder assembly of claim 23, wherein said axial channel has a substantially uniform width.

25. The holder assembly of claim 24, wherein said axial channel is partially formed by a first wall and a second wall, wherein said first and second walls are disposed along a bottom of said axial channel, and wherein said axial slot is disposed between said first and second walls.

26. The holder assembly of claim 25, wherein said holder has an opening in communication with said axial slot and said axial channel, and wherein said opening allows for engagement and disengagement of said plunger with said axial slot and said axial channel.

27. The holder assembly of claim 26, wherein said opening is at least partially defined by said first and second walls.

28. The holder assembly of claim 26, wherein said plunger has a pad connected to said positioner and accessible from outside of said holder, and wherein said pad is made from a first material, said positioner is made from a second material, and said first material is softer than said second material.

29. The holder assembly of claim 28, wherein said first material is co-molded with said second material.

30. The holder assembly of claim 28, wherein said first material is a thermoplastic elastomer.

31. The holder assembly of claim 27, wherein said axial channel is partially formed by a third wall and a fourth wall, wherein said third and fourth walls are disposed along sides of said axial channel, and wherein said third and fourth walls are substantially orthogonal to said first and second walls.

32. The holder assembly of claim 31, wherein said opening is partially formed by said third and fourth walls.

33. The holder assembly of claim 22, wherein said positioner comprises a plate, a rib, and an actuator, wherein said plate is connected to said disk, wherein said actuator is accessible from outside of said holder, wherein said rib connects said plate to said actuator, and wherein said rib is in said first axial track and said actuator has at least a portion thereof that is in said second axial track when said positioner is engaged with said first and second axial tracks.

34. The holder assembly of claim 25, wherein said positioner has a plurality of glide ridges that contact said first and second walls when said plunger is moved along said axial slot.

35. The holder assembly of claim 27, wherein in a front view said positioner has a square or rectangular shape, and wherein in said front view said opening has a trapezoidal shape.

36. The holder assembly of claim 22, wherein said holder has an upper end with a first diameter and a lower end with a second diameter, and wherein said second diameter is greater than said first diameter.

37. The holder assembly of claim 36, wherein said lower end has a stabilizing structure.

38. The holder assembly of claim 22, wherein said holder is transparent.

39. The holder assembly of claim 22, further comprising a nipple ring and a nipple removably securable to said holder.

40. A holder assembly for a disposable liner that expels air from said liner, said holder assembly comprising:

a holder having an outer circumference, an opening, an axial slot in communication with said opening and formed by first and second walls, and an axial channel inwardly recessed from said outer circumference, said axial channel having a channel width; and a plunger having a disk and a positioner connected to said disk, said positioner having a positioner width, wherein said disk is removably disposed in said holder and movable in an axial direction in said holder to urge air from said liner, wherein said positioner has at least a portion thereof that is accessible from outside of said holder along said axial slot, wherein said positioner engages said axial slot along said first and second walls without engaging said holder in an area opposite said axial slot, wherein said opening is at least partially defined by said first and second walls, wherein said positioner can be selectively engaged and disengaged from said axial slot through said opening, and wherein said channel width is greater than said positioner width so that said positioner is at least partially recessed in said axial channel.

41. The holder assembly of claim 40, wherein said holder further comprises a first contact area and a second contact area, wherein said first contact area is a first surface area of a portion of said first wall and a portion of said second wall that are engaged with said positioner when said positioner is remote from said opening, wherein said second contact area is a second surface area of said portions of said first and second walls that are engaged with said positioner when said positioner is in proximity to said opening, and wherein said first contact area is greater than said second contact area.

42. The holder assembly of claim 41, wherein said plunger has a pad connected to said positioner and accessible from outside of said holder, and wherein said pad is made from a first material, said positioner is made from a second material, and wherein said first material is softer than said second material.

43. The holder assembly of claim 41, wherein said first and second walls are along a bottom of said axial channel.

44. The holder assembly of claim 43, wherein said axial channel is partially formed by a third wall and a fourth wall, wherein said third and fourth walls are along sides of said axial channel, and wherein said third and fourth walls are substantially orthogonal to said first and second walls.

45. The holder assembly of claim 44, wherein said opening is partially defined by said third and fourth walls.

46. The holder assembly of claim 41, wherein said positioner comprises a plate, a rib, and an actuator, wherein said plate is connected to said disk, wherein said actuator is accessible from outside of said holder, wherein said rib connects said plate to said actuator, and wherein said rib is disposed in said axial slot when said positioner is engaged with said axial slot.

47. The holder assembly of claim 41, wherein said positioner has a square or rectangular shape when viewed in a front view, and wherein said opening has a trapezoidal shape when viewed in said front view.

48. The holder assembly of claim 41, wherein said disk has a circumferential lip to form a cup-like shape.

49. The holder assembly of claim 41, wherein said holder has an upper end with a first diameter and a lower end with a second diameter, and wherein said second diameter is greater than said first diameter.

50. The holder assembly of claim 49, wherein said lower end has a stabilizing structure.

51. The holder assembly of claim 41, wherein said holder is transparent.

52. A holder assembly for a disposable liner that expels air from said liner, said holder assembly comprising:

a holder having an outer circumference and an axial slot; and a plunger having a disk, a positioner connected to said disk and a pad connected to said positioner, wherein said disk is removably disposed in said holder and movable in an axial direction in said holder along said axial slot to urge air from said liner, wherein said positioner engages said axial slot without engaging said holder in an area opposite said axial slot, wherein said pad is accessible from outside of said holder along said axial slot, wherein said pad is made from a first material, wherein said positioner is made from a second material, wherein said first material is softer than said second material and wherein said first material is a thermoplastic elastomer.

53. The holder assembly of claim 52, wherein said pad is co-molded with said positioner.

54. The holder assembly of claim 52, wherein said holder has an axial channel inwardly recessed from said outer circumference, wherein said axial channel has a channel width that allows at least a portion of said positioner to move through said axial channel along said axial slot, wherein said axial slot is along a bottom of said axial channel, wherein said positioner has a positioner width, and wherein said channel width is greater than said positioner width so that said positioner is at least partially recessed in said axial channel.

55. The holder assembly of claim 52, wherein said positioner is integrally molded with said disk.

56. The holder assembly of claim 52, wherein said holder has an axial channel inwardly recessed from said outer circumference, wherein said axial channel has a width that allows at least a portion of said positioner to move through said axial channel along said axial slot, and wherein said axial slot is along a bottom of said axial channel.

57. The holder assembly of claim 56, wherein said holder has an opening in communication with said axial slot that allows for engagement and disengagement of said positioner with said axial slot.

58. The holder assembly of claim 52, wherein said positioner comprises a plate, a rib, and an actuator, wherein said plate is connected to said disk, wherein said actuator has at least a portion thereof that is accessible from outside of said holder, wherein said rib connects said plate to said actuator, wherein said rib is disposed in said axial slot when said positioner is engaged with said axial slot, and wherein said pad is connected to said actuator.

59. The holder assembly of claim 58, wherein said holder further comprises an opening in communication with said axial slot for engaging and disengaging said positioner with said axial slot, wherein said actuator has a square or rectangular shape when viewed in a front view, and wherein said opening has a trapezoidal shape when viewed in said front view.

60. The holder assembly of claim 52, wherein said holder has an upper end with a first diameter and a lower end with a second diameter, and wherein said second diameter is greater than said first diameter.

61. The holder assembly of claim 60, wherein said lower end has a stabilizing structure.

62. The holder assembly of claim 52, wherein said holder is transparent.

63. The holder assembly of claim 52, further comprising a nipple ring and a nipple removably securable to said holder.

64. A holder assembly for a disposable liner that expels air from said liner, said holder assembly comprising:

a holder having an outer circumference, a first wall, and a second wall, an axial channel being defined in part by said first and second walls, and a single axial slot being formed between said first wall and said second wall, said axial slot being disposed in said axial channel, said first and second walls having inner and outer surfaces; and a plunger having a positioner, said plunger being partially disposed in said holder and movable along a longitudinal axis of said holder to urge air from said liner, said positioner engaging said inner and outer surfaces of said first and second walls, said positioner having a portion thereof that is accessible from outside of said holder and adjacent to said axial slot, wherein said axial slot has an opening at a first end of said axial slot, wherein said opening has an area smaller than an area of said portion of said positioner to allow selective removal of said positioner from said holder, and wherein said positioner has a square or rectangular shape when viewed in a front view, and wherein said opening has a trapezoidal shape when viewed in said front view.

65. The holder assembly of claim 64, wherein said positioner engages said inner and outer surfaces of said first and second walls without engaging said holder in an area opposite said axial slot.

66. The holder assembly of claim 65, wherein said axial channel has a width that allows said portion of said positioner to move through said axial channel.

67. The holder assembly of claim 64, wherein said plunger has a pad connected to said positioner and accessible from outside of said holder, and wherein said pad is made from a first material, said positioner is made from a second material and said first material is softer than said second material.

68. The holder assembly of claim 64, wherein said axial channel is partially formed by a third wall and a fourth wall, and wherein said third and fourth walls are substantially orthogonal to said first and second walls.

69. The holder assembly of claim 64, wherein said axial channel has a channel width, wherein said positioner has a positioner width, and wherein said channel width is greater than said positioner width so that said positioner is at least partially recessed in said axial channel.

70. The holder assembly of claim 64, wherein said holder has an upper end with a first diameter and a lower end with a second diameter, and wherein said second diameter is greater than said first diameter.

71. The holder assembly of claim 70, wherein said holder has a middle portion with a third diameter, and wherein said first and second diameters are greater than said third diameter.

72. The holder assembly of claim 71, wherein said lower end has a stabilizing structure.

73. The holder assembly of claim 72, wherein said stabilizing structure is an outwardly extending bead.

74. The holder assembly of claim 64, wherein said holder is transparent.

75. The holder assembly of claim 64, further comprising a nipple ring and a nipple removably securable to said holder.

76. A holder assembly for a disposable liner that expels air from said liner, said holder assembly comprising:

a holder having an axial slot and an opening; and a plunger having a positioner removably engaged with said axial slot, said plunger being partially disposed in said holder and movable along said axial slot to urge air from said liner, wherein said positioner has at least a portion thereof that is accessible from outside of said holder and adjacent to said axial slot, wherein said positioner engages said axial slot without engaging said holder in an area opposite said axial slot, wherein said positioner is disengageable from said axial slot by moving said positioner in only a first single direction when said positioner is in proximity to said opening, and wherein said axial slot has at least one detent structure disposed adjacent to said opening that allows disengagement of said positioner from said axial slot by movement of said positioner in only said first single direction when said positioner is in proximity to said opening.

77. The holder assembly of claim 76, wherein said positioner is engageable with said axial slot by moving said positioner in only a second single direction when said positioner is in proximity to said opening, and wherein said second direction is opposite to said first direction.

78. The holder assembly of claim 76, wherein said first single direction is a rotational direction.

79. The holder assembly of claim 76, wherein said holder has a first wall and a second wall, wherein said axial slot is formed by said first and second walls, and wherein said first and second walls partially define said opening.

80. The holder assembly of claim 76, wherein said holder has an axial channel inwardly recessed from said outer circumference, wherein said axial channel has a channel width that allows at least a portion of said positioner to move through said axial channel, wherein said axial slot and said opening are formed in said axial channel, wherein said positioner has a positioner width, and wherein said channel width is greater than said positioner width so that said positioner is at least partially recessed in said axial channel.

81. The holder assembly of claim 79, wherein said at least one detent structure is a first tapered edge and a second tapered edge, wherein said first tapered edge is formed on said first wall along a first end of said axial slot adjacent to said opening, and wherein said second tapered edge is formed on said second wall along said first end of said axial slot adjacent to said opening.

82. The holder assembly of claim 79, wherein said holder has an axial channel inwardly recessed from said outer circumference, wherein said axial channel has a width that allows at least a portion of said positioner to move through said axial channel, and wherein said axial slot and said opening are formed in said axial channel.

83. The holder assembly of claim 76, wherein said plunger has a pad connected to said positioner and accessible from outside of said holder, and wherein said pad is made from a first material, said positioner is made from a second material and said first material is softer than said second material.

84. The holder assembly of claim 83, wherein said first material is co-molded with said second material.

85. The holder assembly of claim 84, wherein said first material is a thermoplastic elastomer.

86. The holder assembly of claim 82, wherein said axial channel is partially formed by a third wall and a fourth wall, and wherein said third and fourth walls are substantially orthogonal to said first and second walls.

87. The holder assembly of claim 82, wherein said positioner comprises a plate, a rib, and an actuator, wherein said plate is connected to said disk, wherein said actuator is accessible from outside of said holder, wherein said rib connects said plate to said actuator, and wherein said rib is disposed in said axial slot when said positioner is engaged with said axial slot.

88. The holder assembly of claim 87, wherein said rib, said plate and said actuator define a pair of channels that engage with said first and second walls.

89. The holder assembly of claim 87, wherein said positioner has a plurality of glide ridges that contact said first and second walls when said plunger is moved along said axial slot.

90. The holder assembly of claim 76, wherein said positioner has a square or rectangular shape when viewed in a front view, and wherein said opening has a trapezoidal shape when viewed in said front view.

91. The holder assembly of claim 76, wherein said holder has an upper end with a first diameter and a lower end with a second diameter, and wherein said second diameter is greater than said first diameter.

92. The holder assembly of claim 91, wherein said holder has a middle portion with a third diameter, and wherein said first and second diameters are greater than said third diameter.

93. The holder assembly of claim 91, wherein said lower end has a stabilizing structure.

94. The holder assembly of claim 93, wherein said stabilizing structure is an outwardly extending bead.

95. The holder assembly of claim 76, wherein said holder is transparent.

96. The holder assembly of claim 76, further comprising a nipple ring and a nipple removably securable to said holder.

* * * * *